US006471532B2

(12) United States Patent
Kondas et al.

(10) Patent No.: US 6,471,532 B2
(45) Date of Patent: Oct. 29, 2002

(54) ELECTRICAL ADAPTER

(75) Inventors: Shawn J. Kondas; Daniel L. Hayes, both of Kendallville, IN (US)

(73) Assignee: Pent Assemblies, Inc., Kendallville, IN (US)

( * ) Notice: Subject to any disclaimer, the term of this patent is extended or adjusted under 35 U.S.C. 154(b) by 0 days.

(21) Appl. No.: 09/968,062

(22) Filed: Oct. 1, 2001

(65) Prior Publication Data

US 2002/0019171 A1 Feb. 14, 2002

Related U.S. Application Data

(60) Continuation-in-part of application No. 09/918,061, filed on Jul. 30, 2001, which is a division of application No. 09/307,115, filed on May 7, 1999, now Pat. No. 6,267,613.

(51) Int. Cl.[7] ..... H01R 13/52
(52) U.S. Cl. ..... 439/281
(58) Field of Search ..... 439/281, 218, 439/701, 215, 688, 714, 723, 724, 535, 465

(56) References Cited

U.S. PATENT DOCUMENTS

| | | | | |
|---|---|---|---|---|
| 4,148,546 A | | 4/1979 | Wilson, Jr. et al. | 339/192 R |
| RE31,033 E | | 9/1982 | Wilson, Jr. et al. | 439/743 |
| 4,462,656 A | | 7/1984 | Beyer | 339/154 A |
| 4,740,167 A | * | 4/1988 | Millhimes et al. | 439/92 |
| 5,203,711 A | | 4/1993 | Boogiel | 439/215 |
| 5,542,860 A | | 8/1996 | Bandura | 439/567 |

* cited by examiner

*Primary Examiner*—Renee Luebke
*Assistant Examiner*—Phuong Chi Nguyen
(74) *Attorney, Agent, or Firm*—Taylor & Aust P.C.

(57) ABSTRACT

An adapter for distributing electrical energy has an insulating housing and a plurality of electrical contacts with each contact having at least three radially extending electrically conductive arms terminating near respective ports within the housing. The insulating housing is formed of first and second matable housing portions with each portion having two sets of alignable recesses. Each recess receives a portion of one electrically conductive arm. The first housing portion also has a set of centrally located cavities each aligned with corresponding first housing portion recesses to receive the third conductive arm of a corresponding contact whereby, one arm of each contact may be introduced into each cavity with the other two arms seated in corresponding recesses, and the second housing portion mated to the first housing portion capturing the contacts therein. Optionally, the housing further includes a receptacle terminal accepting port array and each electrical contact includes a fourth radially extending arm. The fourth arm of each contact extends to the receptacle terminal accepting port array. In this case, three of the conductive arms comprise relatively flat coplanar elongated blades and the fourth conductive arm comprises a resilient clip.

21 Claims, 5 Drawing Sheets

ELECTRICAL ADAPTER

CROSS REFERENCE TO RELATED APPLICATIONS

This application is a continuation-in-part of U.S. application Ser. No. 09/918,061 filed Jul. 30, 2001 and entitled "ELECTRICAL TERMINAL BLOCK AND RECEPTACLES", which is a divisional of U.S. application Ser. No. 09/307,115, filed May 7, 1999 and entitled "ELECTRICAL TERMINAL BLOCK AND RECEPTACLES", now U.S. Pat. No. 6,267,613.

BACKGROUND OF THE INVENTION

1. Field of the Invention

The present invention relates to electrical receptacles and, more particularly, to electrical terminal blocks having couplable electrical receptacles and jumpers for electrically coupling terminal blocks with other terminal blocks.

2. Description of the Related Art

Electrical receptacles or outlets are well known as a means for providing an interface between a supply or source of electricity and an appliance, tool, equipment, or the like. Such receptacles come in a variety of plug configurations, most of which are standardized according to the type of use. For instance, most people are familiar with the standard household receptacle which has two slots and a round or D-shaped ground opening.

Because of the proliferation of electrical equipment, electrical outlets or receptacles must be provided almost everywhere. This is especially true in the workplace, where computers, printers, facsimile machines, telephones, and the like must be connected to an electrical outlet. Also, the workplace has evolved to where there is more than just the conventional type of furniture. Now there are modular units, cubicles and the like which may be located away from walls and other structures where electrical receptacles/outlets are traditionally located. In this type of office furniture, electrical receptacles are typically located along the bottom or side rails of the support structures.

However, since there needs to be plenty of electrical receptacles to handle the myriad of office equipment needing electricity, wiring is a problem. Further, there is a need for greater flexibility in locating and configuring the needed electrical receptacles. Coupling the electrical outlets to a source of electrical energy or interconnecting different groups of outlets to convey electrical energy between those groups is a continuing problem. As well, accessibility of the outlets is a concern.

SUMMARY OF THE INVENTION

The present invention provides a jumper and adapter system for readily coupling power from a power source or energized set of terminal blocks to another set of terminal blocks.

The invention comprises, in one form thereof, an adapter for supplying electrical energy from a first power cable, power-in plug and mating adapter port array to a first electrical distribution terminal block, and from the adapter by way of a power-out port array, power-out plug, and power jumper, to a second electrical distribution block. The adapter has an insulating housing with a plurality of contact receiving cavities. A plurality of electrical contacts are disposed within the cavities. Each contact has at least three radially extending electrically conductive arms terminating near respective ports within the housing. One arm of each contact extends to the multiconductor power-in plug receiving port array, another arm of each contact extends to the multiconductor power out-plug receiving port array, and a further arm of each contact is adapted to electrically connect to a corresponding terminal of the first electrical distribution block. At least two of the conductive arms comprise relatively flat coplanar elongated blades while a third comprises a bent clip for receiving a terminal blade. Each of the electrical distribution terminal blocks includes a plurality of interleaved insulating wafers and conductive terminals, and each terminal includes an elongated prong for electrical connection to either an adapter contact or an electrical receptacle terminal.

An advantage of the present invention is that no special modification for supplying energy to a set of terminal blocks need be made.

Another advantage is that the number of duplex outlets normally associated with a set of terminal blocks may remain unchanged despite the addition of a jumper to supply power from that set of terminal blocks to another set of terminal blocks.

A further advantage is that a supply of electrical energy to a set of terminal blocks from a source or another already energized set of terminal blocks may be easily and quickly established without the need for special tools or the services of a skilled electrician.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
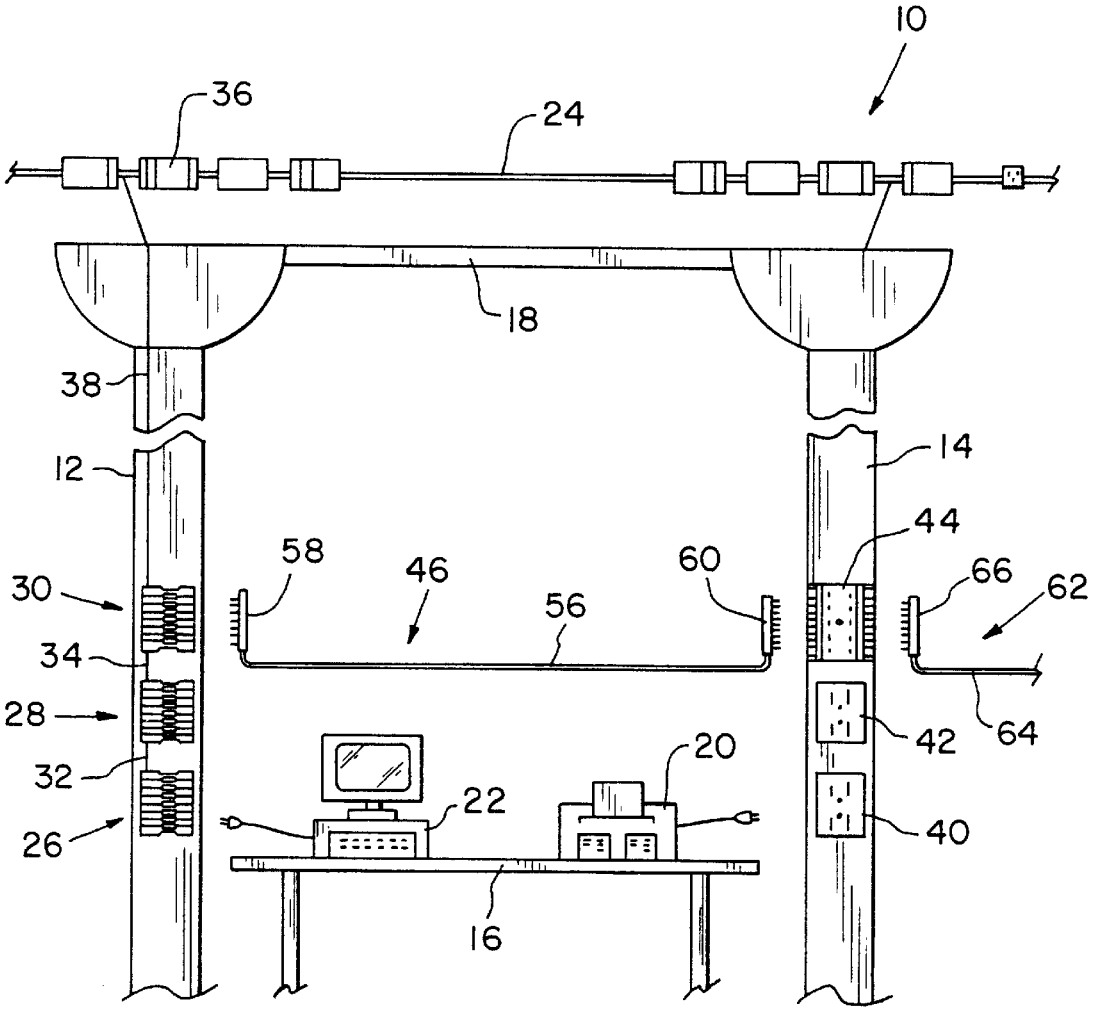
FIG. 1 is a front perspective view of a piece of furniture having vertical support posts with two of the posts having vertically disposed terminal blocks/electrical receptacles therein in accordance with an aspect of the present invention, each terminal block electrically coupled to a source of electricity.

Referring now to the drawings and more particularly to FIG. 1, there is shown furniture 10 supported by vertical column or post 12 on one side of table or platform 16 and vertical column or post 14 on another side of table 16. It should be understood that furniture 10 is representative of any type of furniture, but especially free-standing modular or cubicle office furniture that is supported or incorporates vertical posts, columns, or legs. Extending between posts 12 and 14 is horizontal beam 18 which carries electrical cable 24 therein that is generally coupled to an electrical junction box or the like (not shown) for supplying electricity. Electrical cable 24 may be a typical electrical supply cable that carries three conductors; a ground wire/conductor, a hot wire/conductor, and a neutral wire/conductor, or the like, as is known in the art. Table 16 is shown at a reduced scale supporting a facsimile machine or other telephone equipment 20 and computer 22 which require connection to an electrical receptacle or outlet.

The interior of post 12 contains terminal blocks 26, 28, and 30 in vertical relationship to one another. Terminal block 30 is in electrical communication with electrical cable 24 via electrical cable 38, which typically includes three wires, and junction box or connector 36 which is disposed in horizontal beam 18. Electrical cable 24 is wired to junction box 36 in a manner known in the art, while electrical cable 38 is wired as well at one end to junction box 36. Junction box 36 can also function as a terminal box for a ceiling outlet. The other end of electrical cable 38 is received by terminal block 30 as detailed below. Electrical cable 34, again which typically includes three wires is electrically coupled at one end to terminal block 30 and electrically coupled at its other end to terminal block 28. Electrical cable 32, again which typically includes three wires, is electrically coupled at one end to terminal block 28 and electrically coupled at its other end to terminal block 26. In this manner, electricity is supplied from electrical supply cable 24 to each terminal block 26, 28, and 30. It should here be understood that the number of terminal blocks disposed within a post or column is variable. Thus, only one terminal block may be disposed within the post or as many terminal blocks as can fit within the post may be used. Of course, the number of terminal blocks will be limited by the capacity of the electrical supply.

Post 14 has a first set of electrical outlets 40 that correspond and electrically couple to terminal block 26 and a second set of electrical outlets 42 that correspond and electrically couple to terminal block 28. Instead of a third set of electrical outlets that correspond and electrically couple to terminal block 30, an adapter 44 for conveying power to and from the upper terminal block has been substituted. In general, one electrical outlet per terminal block is disposed on one face of the post. It should be understood that post 12 depicts what is disposed within the interior thereof and thus would include exterior electrical receptacles as shown on post 14. At the same time, post 14 depicts the exterior electrical receptacles mountable to the interior terminal blocks that are not seen, but as depicted with regard to post 12.

Additionally depicted in FIG. 1 is beltline jumper 46 comprised of electrical cable 56 terminating at one end in connector 58 and terminating at the other end in connector 60. Connectors 58 and 60 are configured to be received by one side of a terminal block or by one of the ports of adaptor 44. Beltline jumper 46 may be used to electrically couple one terminal block with another terminal block, each terminal block generally disposed in different posts, and is generally used at table level. Thus, if overhead power is not supplied to each post, beltline jumper 46 may be used to supply power from a terminal block having power to another terminal block not having power. Also depicted in FIG. 1 is floor power entry assembly 62 comprising electrical cable 64 terminating in connector 66. Again, connector 66 is configured to be coupled to or received by one side of a terminal block or by one of the ports of adaptor 44. Floor power entry assembly 62 may be used at floor level to provide power from a power source (not shown) to a terminal block, again if overhead power is not utilized. Also, assembly 62 may be used as a jumper to connect other terminal blocks of other posts at floor level. Assembly 62 may be used in conjunction with beltline jumper 46.

Figure 2:
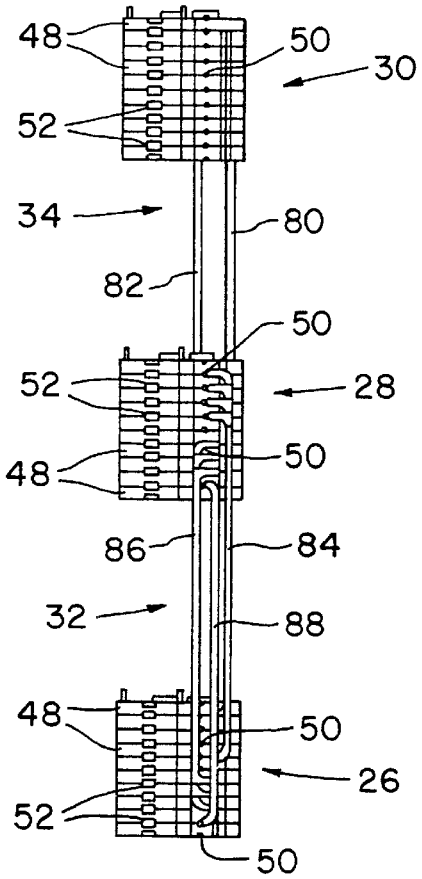
FIG. 2 is an enlarged side view of the vertically disposed terminal blocks from one of the posts of FIG. 1.

With reference now to FIG. 2, there is shown a vertically disposed terminal block stack as depicted within post 12 of FIG. 1. Each terminal block 26, 28, and 30 is formed in part by a plurality of vertically stacked or axially adjacent wafers 48. The number of axially adjacent wafers 48 depends on the desired electrical receptacle/outlet interface configuration. While coupling of the electricity supply from cable 38 may sometimes be employed, an alternative electrical supply from jumper 46 will be described in detail subsequently. Wire ports 50 are formed between axially adjacent wafers 48 and define a plane. Each plane is between axially adjacent wafers 48, and is dedicated to the particular electrical polarity of a received wire/conductor, including ground, associated with the particular port. This includes line, neutral and ground. Further, because of this configuration, any port may be interchanged to accept whatever line or neutral wire as may be needed, as long as the electrical receptacle supports the particular configuration. With a conventional three-wire conductor, one wire would be received in one wire port, another wire would be received in another wire port, while the last wire would be received in yet another wire port. The three incoming wires are electrically coupled to an electrical receptacle as further explained below. Preferably, the wires are coupled to wire ports that are axially adjacent.

Either the incoming jumper 46 or cable 38 feeds at least an upper portion of terminal block 30 which correspond to the upper outlet of an attached or coupled electrical receptacle. Additionally, there are separate wire ports (not seen), one each, for any exiting wire/conductor on another side of terminal block 30. The exiting wires/conductors couple to other wire ports of the same terminal block for supplying electricity to the lower outlet of a coupled electrical receptacle and/or of the upper or lower portion of a different terminal block. In FIG. 2, electrical cable 34 as depicted in FIG. 1, comprises electrical cable 80 and electrical cable 82. Cables 80 and 82 typically have three conductors and are used to distribute the electricity received by terminal block 30.

While not seen in FIG. 2, the electricity that is received into the upper portion of terminal block 30 by jumper cable 46, and feeds the upper outlet of an attached electrical receptacle, is distributed into the lower portion of terminal block 30, which feeds the lower outlet of an attached electrical receptacle. The three conductors of cable 80 exit from wire ports on one side of terminal block 30 and are electrically coupled to either the upper or lower portion wire ports on terminal block 28. In like manner, the three conductors of cable 82 exit from wire ports on another side of terminal block 30 and are electrically coupled to the other of either the upper or lower portion wire ports on terminal block 28. Cable 32 as depicted in FIG. 1, is shown three cables 84, 86, and 88. Cable 84 consists of three wires or conductors that distribute the electricity from the upper portion of terminal block 28 to the upper portion of terminal block 26 via appropriate wire ports 50. Cable 86 also consists of three wires or conductors and distribute the electricity from the lower portion terminal block 28 to the lower portion of terminal block 26. Cable 88 consists of a single wire or conductor and is used to connect ground. It should be understood that the connection scheme described above and depicted in FIG. 2 is only exemplary. The manner and place of connection (relative to one wire port or another) is arbitrary.

Figure 3:
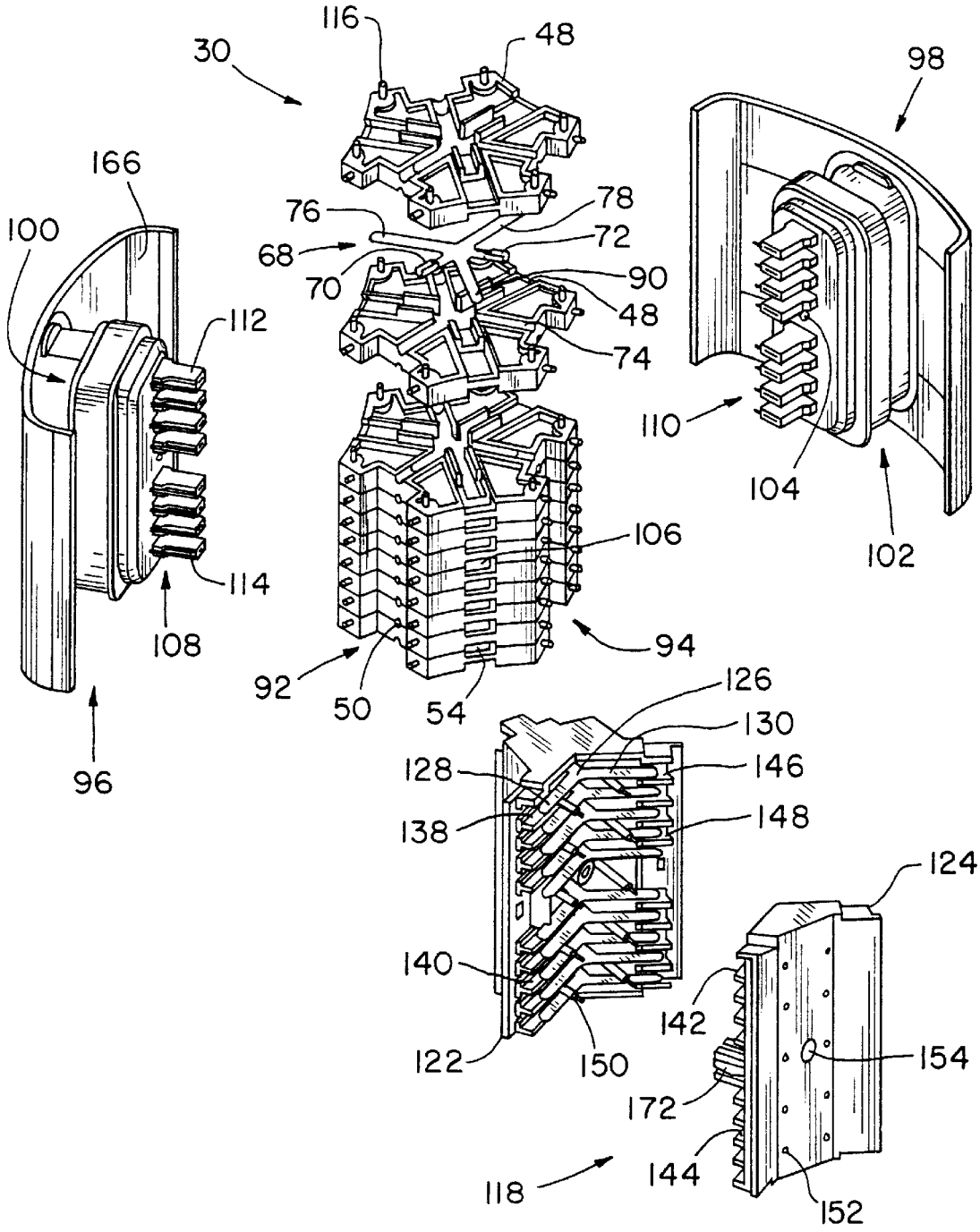
FIG. 3 is an exploded perspective view of a two receptacle terminal block and Y-adapter.

With reference now to FIG. 3, there is shown a partially exploded view of an illustrative terminal block 30 depicting how wafers 48 stack or are axially adjacent one another with a terminal 68 disposed between each axially adjacent pair of wafers adapted to be coupled to terminals of an electrical receptacle. Terminal 68 is formed of an electrically conductive material and has three (3) prongs 76, 78 and 90, and two (2) clips 70 and 72 that each radially extend from common point or middle. Clip 70 rests within one of the wire ducts formed by one of the channels communicating with wire ports 50, and is adapted to receive and hold one wire of an electrical cable as is known in the art. Clip 72 rests in another one of the wire ducts formed by a channel in the upper surface of wafer 48 and a complementary channel of the lower surface of an axially adjacent wafer, and is adapted to receive and hold one wire of an electrical cable as is known in the art. Thus, one clip of clips 70 and 72 maintains an incoming wire, while the other clip of clips 70 and 72 maintains an outgoing wire. Each of the prongs 76, 78 and 90 rests within one of the terminal ducts formed by complementary channels halves of the upper surface on one wafer and of the lower surface of an axially adjacent wafer of each terminal block.

Each terminal 68 is configured such that it can be rotatably oriented relative to the particular wire ducts desired to be the incoming and the outgoing wire ducts out of three possible wire ducts. As an example, clip wire connector clip 70 may rest in a channel which is associated with the column of wire ports 50. This orients terminal 68 such that clip 72 rests in the channel associated with wire port 74. It should be apparent that no matter how terminal 68 is oriented, one of prongs 76, 78, 90 always rests in a terminal duct. Further, as indicated above, any terminal 68 can accept and distribute any polarity or neutral wire to the receptacle as long as the receptacle is configured appropriately.

A post and bore configuration of the wafers includes posts such as 116 extending from the wafer upper surface and corresponding apertures in the wafer lower surfaces and provides an interference fit to retain the wafers in stacked relationship to one another. The terminals 68 are arbitrarily oriented such that any incoming or outgoing wire utilizes either the wire ports 50 on faces or columns 92 or 94 which are recessed relative to the side of the wafer. The recess feature allows room for the electrical cable to vertically enter and exit the terminal block without interference.

Couplable to terminal block 30 are two (2) electrical receptacle assemblies 96 and 98 each having a respective curved face plate such as 166 that each retain a duplex outlet assembly 100 and 102. Each outlet assembly has two conventional outlets, and each is coupled to the terminal block 30 by a screw or the like (not shown) extending through screw hole 104 and into a screw receptacle, of which only screw receptacle 106 can be seen. Screw receptacle 106 is disposed between two of the wafers within the terminal ducts rather than a terminal.

Each electrical outlet assembly 96 and 98 has a terminal bank 108 and 110. Terminal bank 108 consists of eight (8) receptacle terminals such as 112 and 114 that provide electrical communication to an outlet hole of the receptacle. When a prong of a terminal block terminal 68 is coupled to the receptacle terminals, electricity can flow to the outlet holes. Each receptacle terminal is received in a terminal port 52 of the terminal stack 30 wherein a prong of a terminal 68 is disposed. Terminal banks 108 and 110 are identical, and as there are three (3) columns of terminal ports such as 52 and 54 to terminal block 30, three receptacle assemblies might normally be accepted. However, the vertical column or array of terminal ports such as 54 may alternatively be used to direct power to or from the terminal block 30 by way of the beltline jumper 46 and an adapter similar to 44 (FIG. 1).

Figure 4:
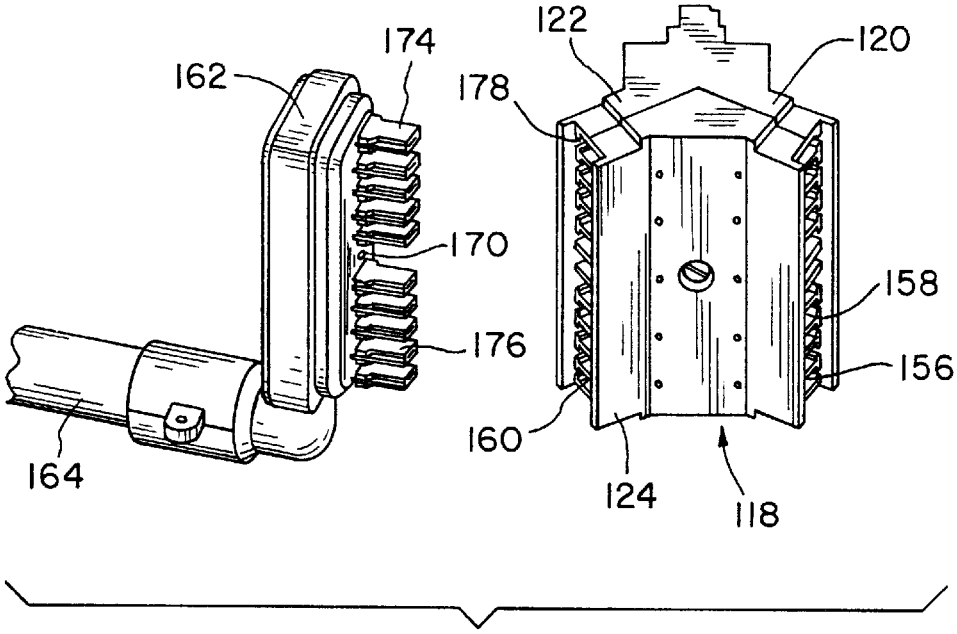
FIG. 4 is a perspective view of a Y-adapter, and a separated power cord and connector.
Figure 5:
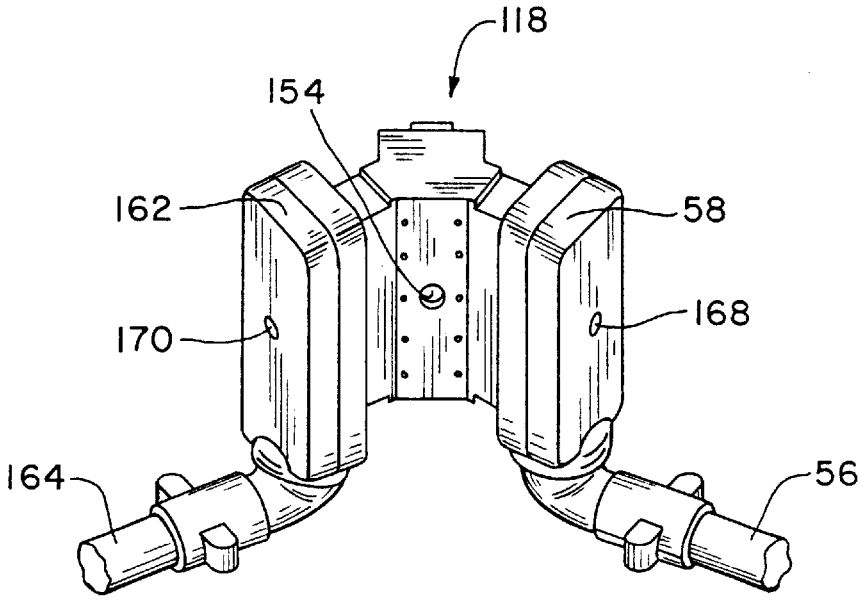
FIG. 5 is a perspective view similar to FIG. 4, but showing two power cords and connectors joined to the Y-adapter.
Figure 6:
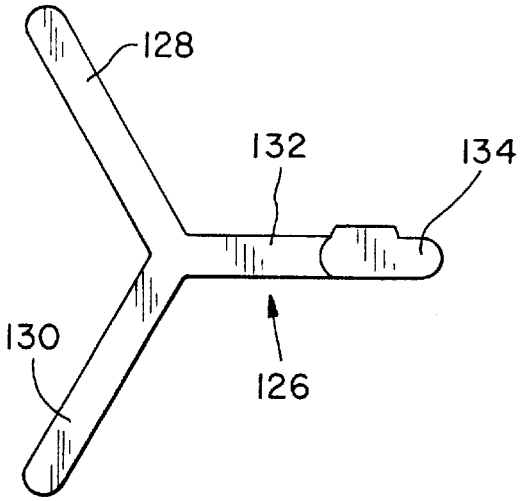
FIG. 6 is a top plan view of an illustrative Y-adapter electrical terminal.
Figure 8:
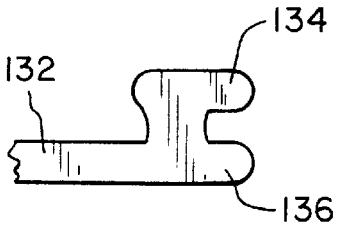
FIG. 8 is a top plan view of a portion of the terminal of FIG. 6 prior to forming.
Figure 7:
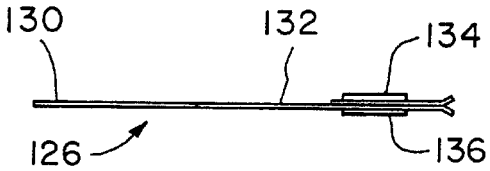
FIG. 7 is a side elevation view of the terminal of FIG. 6.

Y-adapter 118 of FIGS. 3–5 includes an insulating housing 120 formed from two matable housing portions 122 and 124, and containing a number of electrical contacts 126. Each contact has, as illustrated in FIGS. 6–8, three generally equiangularly located electrically conductive arms 128, 130 and 132. The arms 128 and 130 are coplanar elongated blades while the conductive arm 132 comprises a resilient clip for receiving a corresponding terminal block prong such as 90. Clip 132 is formed from a stamped sheet of flat conductive metal by bending the clip halves 134 and 136 of FIG. 8 into the superimposed position of FIGS. 6 and 7.

In FIG. 3, each of the portions 122 and 124 of housing 120 have two sets of alignable recesses. For example, recesses 138 and 140 of housing portion 122 are alignable with recesses 142 and 144 respectively of housing portion 124 and are representatives of a first set of alignable recesses. Recesses such as 146 and 148 are representatives in housing portion 122 of a second set of alignable recesses. Each recess receives a portion of one electrically conductive arm. For example, arm 128 of contact 126 is seated in recess 138 of housing portion 122 and in recess 142 when the housing halves are joined. Arm 130 similarly seats in recess 146 and an alignable recess of housing portion 124 which is not visible in FIG. 3.

Housing portion 122 also has a set of centrally located cavities each aligned with corresponding recesses to receive the third conductive arm 132 of contact 126. In this way, one arm such as 132 of each contact may be introduced into each centrally located cavity in the housing portion 122 and the other two arms such as 128 and 130 seated in corresponding recesses such as 138 and 146, and the second housing portion 124 mated to the first housing portion 122 capturing the contacts therein.

Housing portion 122 further includes a plurality of parallel alignment pins 150 which extend therefrom in a direction generally opposite the centrally located cavities. Housing portion 124 includes corresponding pin receiving apertures 152 and the pins and apertures interengage when the housing portions are mated to align and secure the housing portions together. The pin ends may be upset to stake the housing portions together if desired. Also, both housing portions may include a centrally disposed screw aperture 154 for securing the housing portions together and securing the adapter to an electrical distribution terminal block by engaging the screw receptacle 106. When the housing portions are joined, the aligned recesses form arrays of ports. For example, recesses 138 and 142 align to form port 178 of FIG. 4. The port arrays allow connector access to the contact arms within the adapter. Plug 162, for example, has terminals 174 and 176 which are analogous to receptacle terminals 112 and 114, and electrically mate with ports 178 and 160 respectively. The radially extending electrically conductive arms such as 128, 130 and 132 terminate near respective ports within the housing with one arm 130 of each contact extending to the multiconductor power-in plug receiving port array, another arm 128 of each contact extending to the multiconductor power out-plug receiving port array, and a further arm 132 of each contact adapted to electrically connect to a corresponding terminal 90 of the first electrical distribution block.

Comparing FIGS. 1, 4 and 5, adapter 118 may, for example, be received in terminal block 30 with adapter contact arms such as 132 electrically connected to terminal prongs such as 90 of terminals 68 for supplying electrical energy from power cable 56 by way of a power-in plug 58 and mating adapter port array including ports such as 156 and 158 to the electrical distribution terminal block 30. Power is forwarded from the adapter 118 by way of a power-out port array including ports such as 178 and 160 to power-out plug 162, and power jumper 164 to a further electrical distribution block (not shown). The power-in 58 and power-out 162 plugs each include a centrally located retaining screw aperture 168 and 170 respectively, and housing portion 124 includes corresponding retaining screw receptacles such as 172 located intermediate an adjacent pair of recesses in each set of recesses. In the illustration, cable 56 receives power from floor power entry assembly 62 by way of adapter 44 in an analogous way.

Figure 9:
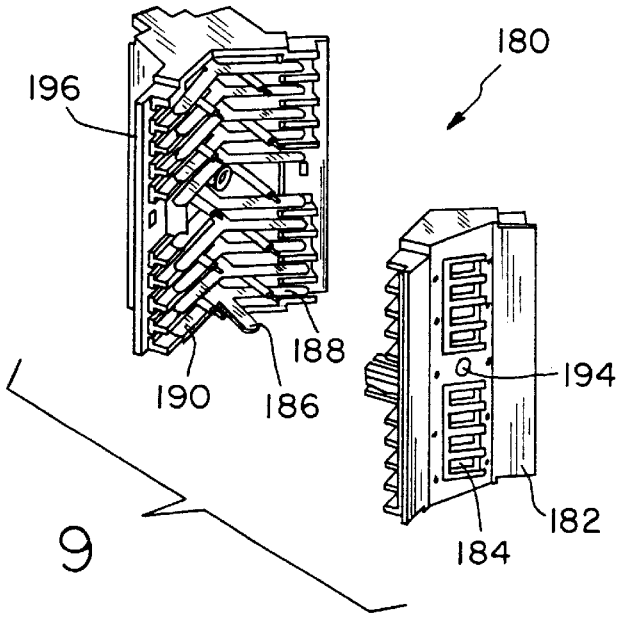
FIG. 9 is an exploded perspective view of a Y-adapter illustrating one variation of the Y-adapter adapter of FIG. 3.
Figure 10:
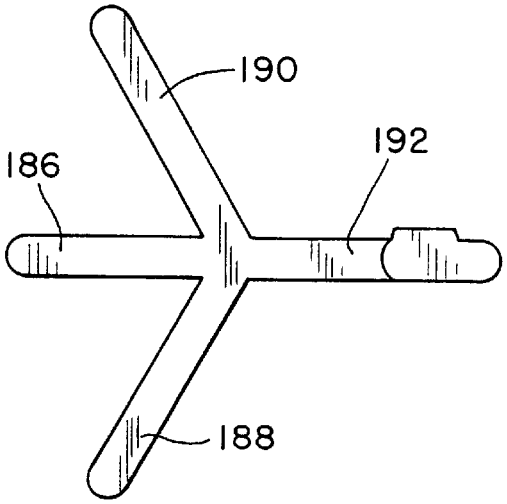
FIG. 10 is top plan view of an illustrative electrical terminal from the Y-adapter of FIG. 9.
Figure 11:
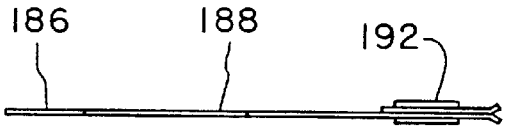
FIG. 11 is a side elevation view of the terminal of FIG. 10.

Each terminal block such as 30 can receive up to three duplex outlet assemblies such as 100 and 102. If the jumper plugs 58 and 162 are simply plugged into the terminal block 30, two of the potential three outlet assemblies are eliminated. Use of the adapter 44 or 118 restores the potential for two outlet assemblies at terminal block 30. Retention of the potential for three outlet assemblies at terminal block 30 while still supplying power thereto and therefrom by the beltline jumper 46 may be achieved by utilization of the modified adapter 180 of FIGS. 9–11.

Adapter 180 is generally similar to adapters 44 and 118, but includes a set of centrally located transverse cavities in the housing portion 182 which determine a receptacle terminal accepting array of ports such as 184. An outlet assembly like 100 or 102, but typically lacking the curved face plate 166, can be plugged directly into and receive energy from this port array. Each of the electrical contacts which are captured between the housing halves include a fourth radially extending arm 186. Contact arm 186 is for supplying power to an outlet received in the array of ports 184. The remaining radially extending arms are substantially the same as arms 130, 128 and 132 discussed earlier, compare FIGS. 6 and 10. Three of the conductive arms 186, 188 and 190 comprise relatively flat coplanar elongated blades and the fourth conductive arm 192 comprises a resilient clip for receiving a corresponding terminal block prong such as 90. The three elongated blades are generally equiangularly located and the fourth conductive arm 186 extends radially generally bisecting the angle between the two elongated blades 188 and 190. The fourth arm of each contact, of course, extends to a corresponding port 184 of the receptacle terminal accepting port array. Again, a retaining screw receptacle 194 located centrally in the housing portion 182, and possibly extending into or through the other housing portion at 196, is provided for receiving a receptacle assembly retaining screw.

The use of conductor strips or bars and movable terminals allows variation in the configuration of the outlet from the terminal block as well as the number of polarity wires. For example, such a receptacle allows for the use of 3-3-2 (three line, three neutral, and two ground) type wiring or other wiring, without having to have dedicated conductors for the differently configured receptacles. The adapters 44, 118 and 180 are illustrated as having ten ports in each array to receive ten plug terminals. This could, for example, provide two separate systems each having two hot, two neutral and one ground wire.

Further, it should be appreciated that the wafers may be made with more or less sides to accommodate more or less electrical receptacles and/or more or less incoming/outgoing wires. The terminal between the wafers would be easily modifiable to have more or less prongs and/or clips. Also, receptacles having more or less than two outlets is attainable.

It should also be recognized that while the present invention has been described and shown as applicable to vertical members associated with furniture, the present invention may be used for other applications where electrical outlets are needed in whatever orientation and thus is not limited to vertical posts, particular types or pieces of furniture, or even furniture.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An adapter for distributing electrical energy, comprising an insulating housing and a plurality of electrical contacts, each contact having at least three radially extending electrically conductive arms terminating near respective ports within the housing, the insulating housing comprising first and second matable housing portions, each portion having two sets of alignable recesses, each recess receiving a portion of one electrically conductive arm, the first housing portion having a set of centrally located cavities each aligned with corresponding first housing portion recesses to receive a third conductive arm of a corresponding contact whereby, one arm of each contact may be introduced into each cavity with two other arms seated in corresponding recesses, and the second housing portion mated to the first housing portion capturing the contacts therein.

2. The adapter of claim 1, wherein the housing further includes a receptacle terminal accepting port array and each electrical contact includes a fourth radially extending arm, the fourth arm of each contact extending to the receptacle terminal accepting port array.

3. The adapter of claim 2, wherein three of said conductive arms comprise relatively flat coplanar elongated blades and the fourth of said conductive arms comprises a resilient clip.

4. The adapter of claim 2, wherein the three elongated blades are generally equiangularly located and the fourth of said conductive arms extends radially generally bisecting the angle between two elongated blades.

5. An adapter for supplying electrical energy from a first power cable by way of a power-in plug and mating adapter port array to a first electrical distribution terminal block and from the adapter by way of a power-out port array, power-out plug, and power jumper to a second electrical distribution block, comprising a plurality of stacked elements together defining an insulating housing, said insulating housing having a plurality of contact receiving cavities, a plurality of electrical contacts, each disposed within a corresponding cavity and each having at least three radially extending electrically conductive arms terminating near respective ports within the housing, one arm of each contact extending to the multiconductor power-in plug receiving port array, another arm of each contact extending to the multiconductor power out-plug receiving port array, and a further arm of each contact adapted to electrically connect to a corresponding terminal of the first electrical distribution block.

6. The adapter of claim 1, wherein two of said conductive arms comprise relatively flat coplanar elongated blades.

7. The adapter of claim 1, wherein the first electrical distribution terminal block includes a plurality of interleaved insulating wafers and conductive terminals, each terminal including an elongated prong for electrical connection to one of an adapter contact and an electrical receptacle terminal.

8. The adapter of claim 1, wherein there are exactly three generally equiangularly located electrically conductive arms.

9. The adapter of claim 1, wherein each said stacked element defines a plurality of channels, each said contact receiving cavity being defined by one said channel.

10. The adapter of claim 1, further including a receptacle terminal accepting port array wherein each electrical contact includes a fourth radially extending arm, the fourth arm of each contact extending to the receptacle terminal accepting port array.

11. The adapter of claim 10, wherein three of said conductive arms comprise relatively flat coplanar elongated blades and the fourth of said conductive arms comprises a resilient clip for receiving a corresponding terminal block prong.

12. The adapter of claim 11, wherein the three elongated blades are generally equiangularly located and the fourth of said conductive arms extends radially generally bisecting the angle between two elongated blades.

13. An adapter for supplying electrical energy from a first power cable by way of a power in plug and mating adapter port array to a first electrical distribution terminal block and from the adapter by way of a power-out port array, power-out plug, and power jumper to a second electrical distribution block, comprising an insulating housing having a plurality of contact receiving cavities, a plurality of electrical contacts, each disposed within a corresponding cavity and each having at least three radially extending electrically conductive arms terminating near respective ports within the housing, one arm of each contact extending to the multiconductor power-in plug receiving port array, another arm of each contact extending to the multiconductor power out-plug receiving port array, and a further arm of each contact adapted to electrically connect to a corresponding terminal of the first electrical distribution block, said insulating housing comprises first and second matable housing portions, each portion having two sets of alignable recesses, each recess receiving a portion of one electrically conductive arm, the first housing portion having a set of centrally located cavities each aligned with corresponding first housing portion recesses to receive a third conductive arm of a corresponding contact whereby, one arm of each contact may be introduced into each centrally located cavity with two other arms seated in corresponding recesses, and the second housing portion mated to the first housing portion capturing the contacts therein.

14. The adapter of claim 13, wherein the first housing portion further includes a plurality of parallel alignment pins extending therefrom in a direction generally opposite the centrally located cavities, and the second housing portion includes corresponding pin receiving apertures, the pins and apertures interengaging when the housing portions are mated to align and secure the housing portions together.

15. The adapter of claim 13, wherein the first and second housing portions each include a centrally disposed screw aperture for securing the housing portions together and securing the adapter to an electrical distribution terminal block.

16. The adapter of claim 13, wherein the power-in and power-out plugs each include a centrally located retaining screw aperture and one of the housing portions includes corresponding retaining screw receptacles located intermediate an adjacent pair of recesses in each set of recesses.

17. The adapter of claim 13, wherein the sets of alignable recesses, when joined, form the port arrays.

18. The adapter of claim 13, further comprising a set of centrally located cavities in the second housing portion determining a receptacle terminal accepting port array, each electrical contact including a fourth radially extending arm, the fourth arm of each contact extending to a corresponding port of the receptacle terminal accepting port array.

19. The adapter of claim 18, wherein three of said conductive arms comprise relatively flat coplanar elongated blades and the fourth of said conductive arms comprises a resilient clip for receiving a corresponding terminal block prong.

20. The adapter of claim 19, wherein the three elongated blades are generally equiangularly located and the fourth of said conductive arms extends radially generally bisecting the angle between two elongated blades.

21. The adapter of claim 20, further comprising a retaining screw receptacle located centrally in the second housing portion for receiving a receptacle assembly retaining screw.

* * * * *